US011117373B2

(12) United States Patent
Mizuno

(10) Patent No.: US 11,117,373 B2
(45) Date of Patent: Sep. 14, 2021

(54) LIQUID EJECTION HEAD

(71) Applicant: Brother Kogyo Kabushiki Kaisha, Nagoya (JP)

(72) Inventor: Taisuke Mizuno, Yokkaichi (JP)

(73) Assignee: Brother Kogyo Kabushiki Kaisha, Nagoya (JP)

( * ) Notice: Subject to any disclaimer, the term of this patent is extended or adjusted under 35 U.S.C. 154(b) by 0 days.

(21) Appl. No.: 16/825,241

(22) Filed: Mar. 20, 2020

(65) Prior Publication Data

US 2020/0307206 A1 Oct. 1, 2020

(30) Foreign Application Priority Data

Apr. 1, 2019 (JP) ..... JP2019-069612

(51) Int. Cl.
*B41J 2/14* (2006.01)

(52) U.S. Cl.
CPC .. *B41J 2/14201* (2013.01); *B41J 2002/14419* (2013.01)

(58) Field of Classification Search
CPC ..... B41J 2/14201; B41J 2002/14419; B41J 2002/14241; B41J 2/14233; B41J 2202/12
See application file for complete search history.

(56) References Cited

FOREIGN PATENT DOCUMENTS

JP 2017-077643 A 4/2017

*Primary Examiner* — Lisa Solomon
(74) *Attorney, Agent, or Firm* — Banner & Witcoff, Ltd.

(57) ABSTRACT

A liquid ejection head includes pressure chambers arranged in a first direction, supply communicating portions, a supply channel, return communicating portions and a return channel. The supply channel includes a first and a second supply portion. The return channel includes a first and a second return portion. The second return portion extends from the first return portion toward the pressure chambers in a second direction orthogonal to the first direction and is located to a side of the supply channel opposite to the pressure chambers in a third direction orthogonal to both the first and the second direction. The second supply portion extends from an end portion of the first supply portion in the third direction toward the pressure chambers in the second direction. The supply communicating portions are located adjacent to the second supply portion in the third direction.

15 Claims, 5 Drawing Sheets

LIQUID EJECTION HEAD

CROSS-REFERENCE TO RELATED APPLICATION

This application claims priority from Japanese Patent Application No. 2019-069612 filed on Apr. 1, 2019, the content of which is incorporated herein by reference in its entirety.

TECHNICAL FIELD

Aspects described herein relate to a liquid ejection head including a plurality of pressure chambers, and a supply channel and a return channel which communicate with the pressure chambers.

BACKGROUND

A known liquid ejection head includes a plurality of pressure chambers, a supply channel communicating with the pressure chambers, and a circulating channel (return channel) communicating with the pressure chambers. The supply channel and the circulating channel are located on the same side of each pressure chamber, and the circulating channel and each pressure chamber define the supply channel therebetween. The supply channel communicates with each pressure chamber via a fluid resistor extending from a side surface of the supply channel. The supply channel and the circulating channel define a space (for a damper chamber) therebetween.

SUMMARY

In the known liquid ejection head, the supply channel and the fluid resistor are arranged alongside in a width direction of the supply channel. If the known liquid ejection head is reduced in size in the width direction of the supply channel, maintaining the width of the supply channel may become difficult. Even if a damper chamber is located across the entire of the supply channel, the size of the damper chamber may be too small to attain a sufficient damping effect on the supply channel.

According to one or more aspects of the disclosure, a liquid ejection head includes a plurality of pressure chambers arranged in a first direction, a plurality of supply communicating portions each communicating with a corresponding one of the pressure chambers, a supply channel extending in the first direction and communicating with each of the supply communicating portions, a plurality of return communicating portions each communicating with a corresponding one of the pressure chambers, and a return channel extending in the first direction and communicating with each of the return communicating portions. The supply channel includes a first supply portion located to one side of each of the pressure chambers in a second direction orthogonal to the first direction, and a second supply portion connecting the first supply portion and the supply communicating portions. The return channel includes a first return portion located to the one side of each of the pressure chambers in the second direction, and second return portion connecting the first return portion and the return communicating portions. The first return portion and each of the pressure chambers sandwich the first supply portion of the supply channel therebetween in the second direction. The second return portion of the return channel extends from the first return portion toward the pressure chambers in the second direction and is located to a side of the supply channel opposite in a third direction to the pressure chambers, the third direction being orthogonal to both the first direction and the second direction. The second supply portion of the supply channel extends from an end portion of the first supply portion in the third direction toward the pressure chambers in the second direction. The supply communicating portions are located adjacent to the second supply portion in the third direction.

DETAILED DESCRIPTION

First Embodiment

Figure 1:
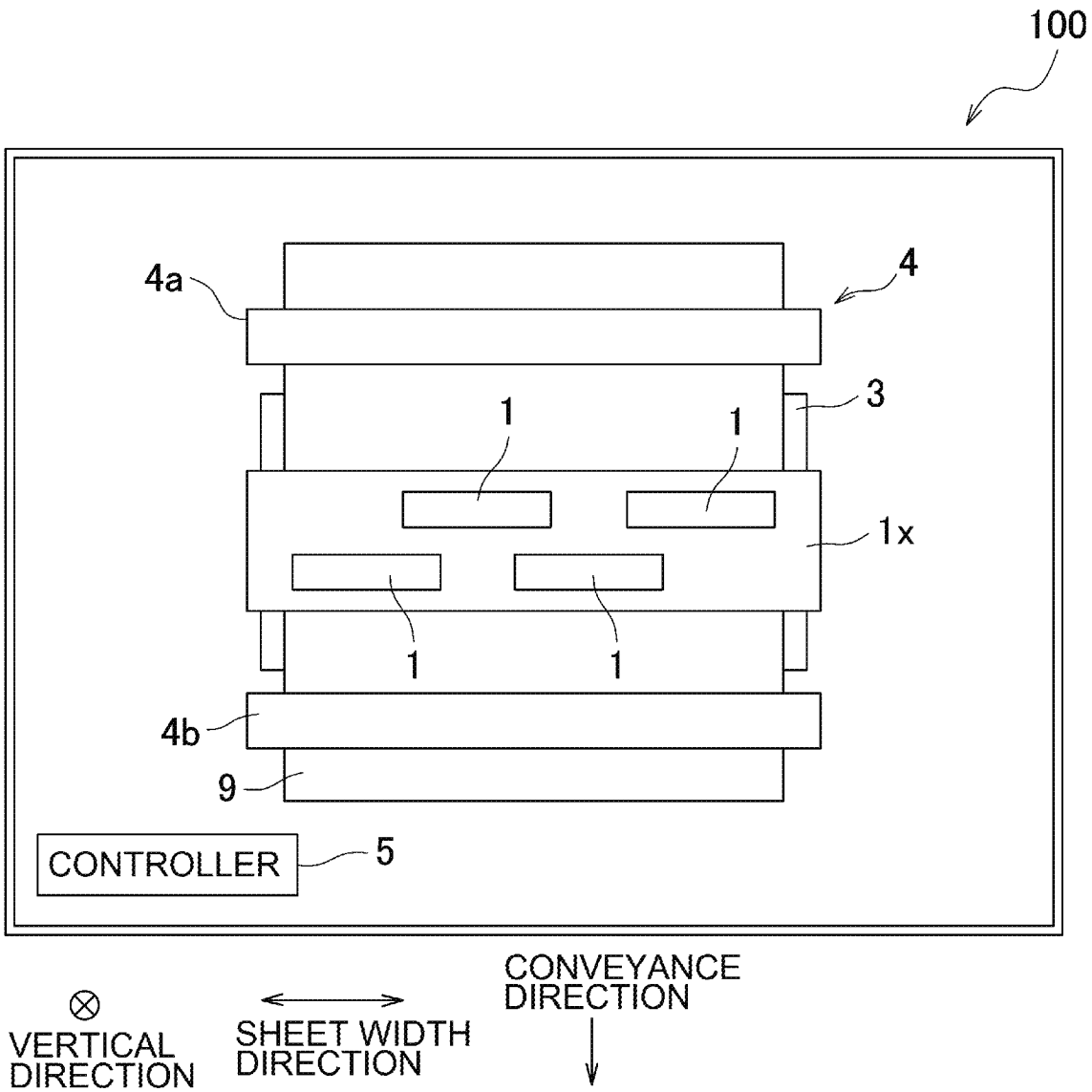
FIG. 1 is a plan view of a printer including a plurality of heads according to a first embodiment of the disclosure.

Referring to FIG. 1, an overall structure of a printer 100 including heads 1 according to a first embodiment of the disclosure will be described.

The printer 100 includes a head unit 1*x* with four heads 1, a platen 3, a conveyor 4, and a controller 5.

The platen 3 receives a sheet 9 on its upper surface.

The conveyor 4 includes two roller pairs 4*a*, 4*b* which are disposed opposite to each other with the platen 3 therebetween in a conveyance direction. When a motor 4*m* (FIG. 4) is driven under control by the controller 5, the roller pairs 4*a*, 4*b* rotate while nipping the sheet 9 therebetween to convey the sheet 9 in the conveyance direction.

The head unit 1*x* is elongated in a sheet width direction orthogonal to both of the conveyance direction and a vertical direction. The head unit 1*x* is a line-head unit having stationary heads to eject ink toward the sheet 9 from nozzles 21 (FIGS. 2 and 3) in form of ink droplets. The four heads 1 are elongated in the sheet width direction and disposed in two rows in a staggered configuration in the sheet width direction.

The controller 5 includes ROM (read only memory), RAM (random access memory), and ASIC (application specific integrated circuit). The ASIC performs recording processing in accordance with programs stored in the ROM. In the recording processing, the controller 5 controls a driver IC 1*d* (FIG. 4) of each head 1 and the motor 4*m* (FIG. 4) with a recording command (including image data) input from an external device, for example, a PC, to record an image on the sheet 9.

Figure 2:
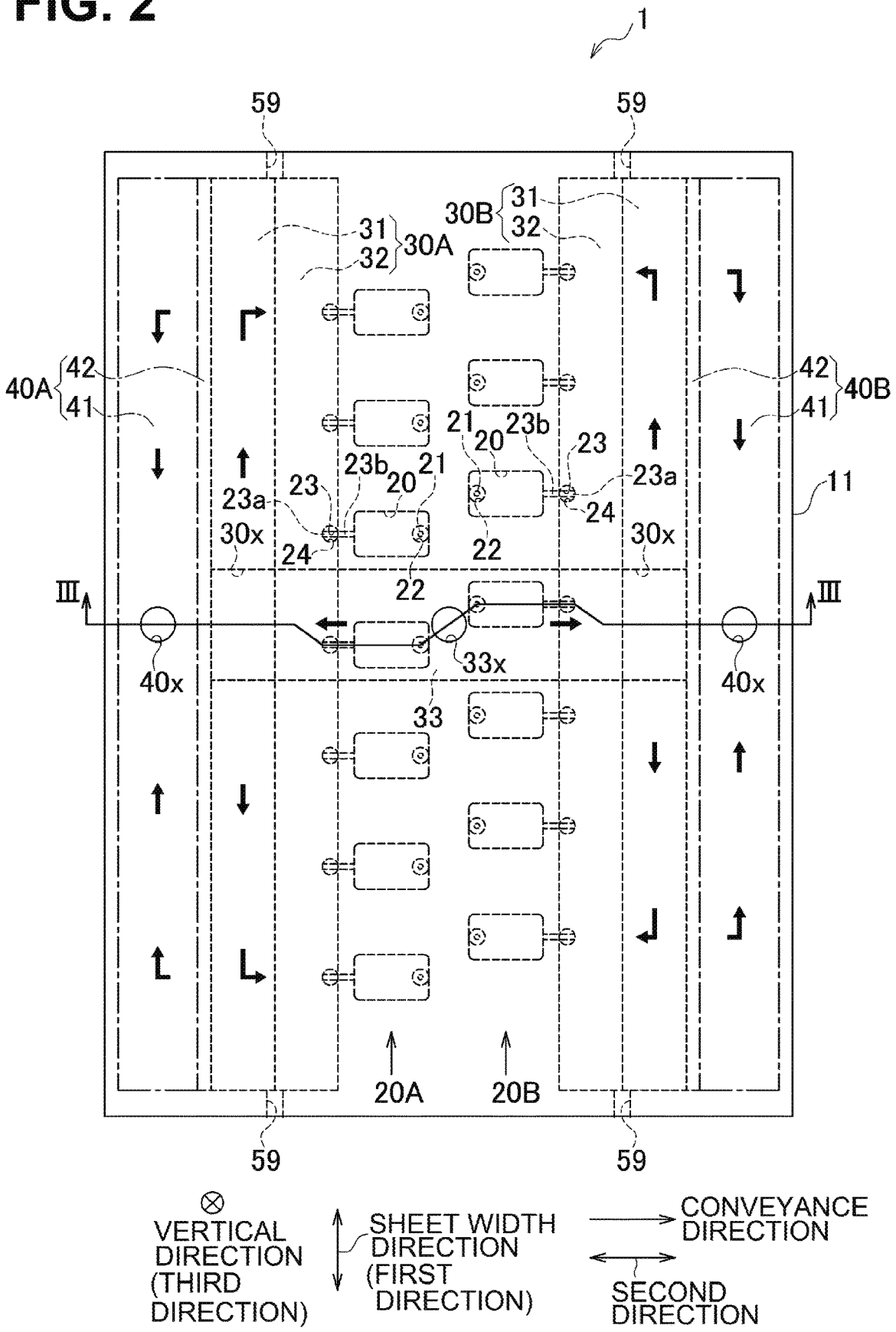
FIG. 2 is a plan view of a head.
Figure 3:
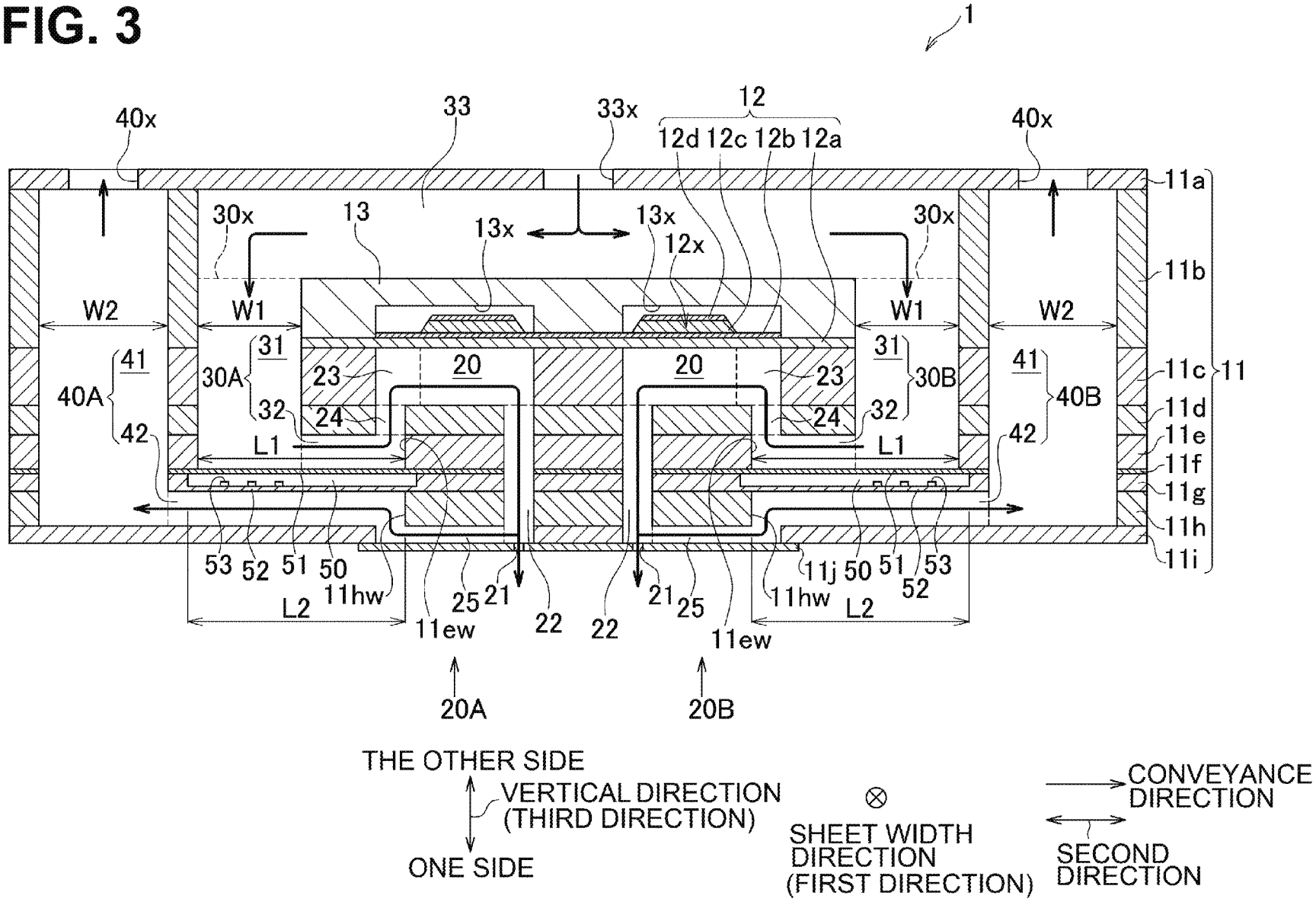
FIG. 3 is a sectional view of the head taken along a line III-III of FIG. 2.

Referring to FIGS. 2 and 3, a structure of a head 1 will be described.

As illustrated in FIG. 3, the head 1 includes a channel substrate 11, an actuator substrate 12, and a protective substrate 13.

As illustrated in FIG. 2, the channel substrate 11 includes a plurality of pressure chambers 20, a plurality of nozzles 21, supply channels 30A, 30B, and return channels 40A, 40B.

The pressure chambers 20 are arranged in two staggered rows in the sheet width direction (hereinafter referred to as a first direction), constituting a first pressure chamber group 20A and a second pressure chamber group 20B. The first pressure chamber group 20A and the second pressure chamber group 20B are arranged alongside in a direction parallel to the conveyance direction (hereinafter referred to as a second direction), and each include pressure chambers 20 spaced at regular intervals in the first direction. Each pressure chamber 20 has a rectangular shape elongated in the second direction on a plane orthogonal to the vertical direction (hereinafter referred to as a third direction). The third direction is orthogonal to both of the first direction and the third direction.

Each of the pressure chambers 20 is connected, at its one end in the second direction, to a corresponding one of narrowed portions 23. As illustrated in FIG. 2, the narrowed portions 23 are smaller in width (a dimension in the first direction) than the pressure chambers 20 and extend in the second direction. As illustrated in FIG. 3, the narrowed portions 23 are equal in depth (a dimension in the third direction) to the pressure chambers 20.

Each of the narrowed portions 23 is connected, at its lower end (or an end on one side in the third direction), to a corresponding one of supply communicating portions 24. As illustrated in FIG. 2, the supply communicating portions 24 are circular channels each having a diameter larger than a width (a dimension in the first direction) of a corresponding one of the narrowed portions 23. The supply communicating portions 24 extends in the third direction. As illustrated in FIG. 3, the supply communicating portions 24 are located below the narrowed portions 23 and the pressure chambers 20 (or located to one side of each of the narrowed portions and the pressure chambers in the third direction, or located adjacent to each of the narrowed portions in the third direction). The supply communicating portions 24 communicate with the narrowed portions 23 which communicate with the pressure chambers 20.

As illustrated in FIG. 2, each of the narrowed portions 23 has a first end 23*a* and a second end 23*b* in the send direction. Each of the narrowed portions 23 communicates with a corresponding one of the supply communicating portions 24 at the first end 23*a*, and a corresponding one of the pressure chambers 20 at the second end 23*b*. The first end 23*a* of each narrowed portion 23 in the second direction overlaps a corresponding supply communicating portion 24 in the third direction.

A narrowed portion 23 and a supply communicating portion 24 are provided for each pressure chamber 20.

Narrowed portions 23 and supply communicating portions 24 provided for the first pressure chamber group 20A are located opposite to the second pressure chamber group 20B relative to the first pressure chamber group 20A in the second direction. Narrowed portions 23 and supply communicating portions 24 provided for the second pressure chamber group 20B are located opposite to the first pressure chamber group 20A relative to the second pressure chamber group 20B in the second direction. In the second direction, the first pressure chamber group 20A and the second pressure chamber group 20B are located between a row of the narrowed portions 23 and the supply communicating portions 24 provided for the first pressure chamber group 20A and a row of the narrowed portions 23 and the supply communicating portions 24 provided for the second pressure chamber group 20B.

The supply channel 30A and the return channel 40A are provided for the first pressure chamber group 20A, and the supply channel 30B and the return channel 40B are provided for the second pressure chamber group 20B. In other words, the supply channel 30A and the return channel 40A communicate with pressure chambers 20 in the first pressure chamber group 20A, and the supply channel 30B and the return channel 40B communicate with pressure chambers 20 in the second pressure chamber group 20B. The supply channels 30A, 30B and the return channels 40A, 40B extend in the first direction and have the same length in the first direction.

The supply channel 30A and the return channel 40A are located opposite to the second pressure chamber group 20B relative to the first pressure chamber group 20A in the second direction. The supply channel 30B and the return channel 40B are located opposite to the first pressure chamber group 20A relative to the second pressure chamber group 20B in the second direction. In the second direction, the first pressure chamber group 20A and the second pressure chamber group 20B are located between the supply channel 30A and the supply channel 30B.

Each of the supply channels 30A, 30B includes a first supply portion 31 and a second supply portion 32. The first supply portion 31 and the second supply portion 32 are channels extending in the first direction and have the same length in the first direction.

As illustrated in FIG. 3, the first supply portion 31 has a greater depth (a dimension in the third direction) than the second supply portion 32.

The second supply portion 32 extends from a lower end portion of the first supply portion 31 (or an end portion of the first supply portion on one side in the third direction, opposite to the pressure chambers) toward the pressure chambers 20 in the second direction and connects the first supply portion 31 and the supply communicating portions 24. The supply communicating portions 24 are located above the second supply portion 32 (or located to the other side of the second supply portion in the third direction or adjacent to the second supply portion in the third direction). The second supply portion 32 communicates with the supply communicating portions 24 which communicate with the pressure chambers 20.

An upper end of the first supply portion 31 of the supply channel 30A and an upper end of the first supply portion 31 of the supply channel 30B are merged into a merging channel 33. The merging channel 33 extends in the second direction above the first pressure chamber group 20A and the second pressure chamber group 20B. As illustrated in FIG. 2, the merging channel 33 is located in a center of the channel substrate 11 in the first direction.

An upper surface of the merging channel 33 has an opening 33*x*. The opening 33*x* is located in a center of the merging channel 33 in the second direction and between the first pressure chamber group 20A and the second pressure chamber group 20B.

The opening 33*x* communicates with a sub tank (omitted from the drawings).

The sub tank communicates with a main tank and stores ink supplied from the main tank. When a circulating pump 7*p* (FIG. 4) is driven under control by the controller 5, ink in the sub tank is allowed to enter the merging channel 33 from the opening 33*x*.

As illustrated in FIGS. 2 and 3, ink entering the merging channel 33 from the opening 33*x* moves to both ends of the merging channel 33 in the second direction. Ink then enters the first supply portions 31 of the supply channels 30A, 30B from respective supply openings 30*x* provided at the upper ends of the first supply portions 31 (or ends of the first supply portions, which are opposite in the third direction to a damper chamber). Ink entering the first supply portions 31 moves toward both ends of the respective first supply portions 31 in the first direction as illustrated in FIG. 2 and downward (or toward one side in the third direction), and enters the second supply portions 32 as illustrated in FIG. 3. Ink entering the second supply portions 32 passes through the supply communicating portions 24 and the narrowed portions 23, which are provided for their respective pressure chambers 20, and then enters each of the pressure chambers 20.

Each of the pressure chambers 20 is connected to a corresponding one of connection channels 22 at an end of each of the pressure chambers 20 in the second direction, which is opposite to a corresponding one of the narrowed portions 23. The connection channels 22 extend downward (or toward one side in the third direction) from the pressure chambers 20 and connect the pressure chambers 20 and nozzles 21. The nozzles 21 are located directly below the connection channels 22. The pressure chambers 20 communicate with the connection channels 22 which communicate with the nozzles 21.

Each of the connection channels 22 is connected, at its lower end portion (or an end portion on one side in the third direction), to a corresponding one of return communicating portions 25. The return communicating portions 25, although omitted from FIG. 2, are narrow channels each having substantially the same width (a dimension in the first direction) as that of a corresponding narrowed portion 23, and extend in the second direction.

A connection channel 22, a nozzle 21, and a return communicating portion 25 are provided for each pressure chamber 20.

Connection channels 22 and nozzles 21 provided for the first pressure chamber group 20A are located on the same side of the first pressure chamber group 20A, which is adjacent to the second pressure chamber group 20B in the second direction. Connection channels 22 and nozzles 21 provided for the second pressure chamber group 20B are located on the same side of the second pressure chamber group 20B, which is adjacent to the first pressure chamber group 20A in the second direction.

Return communicating portions 25 provided for the first pressure chamber group 20A extend in a direction away from the second pressure chamber group 20B relative to the second direction. Return communicating portions 25 provided for the second pressure chamber group 20B extend in a direction away from the first pressure chamber group 20A relative to the second direction.

Each of the return channels 40A, 40B includes a first return portion 41 and a second return portion 42. The first return portion 41 and the second return portion 42 are channels extending in the first direction and have the same length in the first direction.

As illustrated in FIG. 3, the first return portion 41 has a greater depth (a dimension in the third direction) than the second return portion 42.

The first return portion 41 has a width W2 (a dimension in the second direction) greater than a width W1 of the first supply portion 31. In other words, the width W1 of the first supply portion 31 is smaller than the width W2 of the first return portion 41. As the first supply portion 31 is merged into the merging channel 33, a pressure loss between the first supply portion 31 and the merging channel 33 is low. Thus, there is no need to increase the width of the first supply portion 31 to as large as that of the first return portion 41. Narrowing the width W1 of the first supply portion 31 contributes to reducing the size of the head 1 in the second direction.

The second return portion 42 extends from a lower end portion of the first return portion 41 (or an end portion of the first return portion on one side in the third direction, opposite to the pressure chambers) toward the pressure chamber 20 in the second direction and connects the first return portion 41 and the return communicating portion 25. The second return portion 42 communicates with the return communicating portions 25 which communicate with the respective pressure chambers 20.

An upper surface of each first return portion 41 has a return opening 40*x*. The return opening 40*x* is located in a center of each first return portion 41 in the first direction and at the same position as the opening 33*x* in the first direction. The return opening 40*x* communicates with a sub tank (omitted from the drawings), as with the opening 33*x*.

As illustrated in FIG. 3, ink entering each pressure chamber 20 moves downward through its associated connection channel 22. Some of ink is ejected in form of ink droplets from an associated nozzle 21, and the rest of ink passes through an associated return communicating portion 25 and enters an associated second return portion 42. Ink entering the second return portion 42 moves in the second direction and enters the lower end of the first return portion 41. Ink entering the lower end of the first return portion 41 moves upward (or toward the other side in the third direction) as illustrated in FIG. 3 and then toward the center of the first return portion 41 in the first direction as illustrated in FIG. 2, and thus flows out from the return opening 40*x*. Ink flowing out from the return opening 40*x* is returned to the sub tank.

Ink is thus circulated between the sub tank and the channel substrate 11. The circulation of ink reduces air bubbles formed in the channel substrate 11 and prevents the viscosity of ink from increasing. For ink having settling ingredients (e.g., pigments) which settle down and form a sediment, the circulation of ink stirs the settling ingredients, thus preventing the settling ingredients from settling down.

The first supply portion 31 and the first return portion 41 provided for each of the first pressure chamber group 20A and the second pressure chamber group 20B are located on one side (or the same side) of the pressure chambers 20 included in a corresponding one of the first pressure chamber group 20A and the second pressure chamber group 20B in the second direction. In this embodiment, the first supply portion 31 and the first return portion 41 provided for the first pressure chamber group 20A are located opposite to the second pressure chamber group 20B relative to the first pressure chamber group 20A in the second direction. The first supply portion 31 and the first return portion 41 provided for the second pressure chamber group 20B are located opposite to the first pressure chamber group 20A relative to the second pressure chamber group 20B in the second direction.

Regarding each of the first pressure chamber group 20A and the second pressure chamber group 20B, the first supply portion 31 is located between the first return portion 41 and each of the pressure chambers 20 in the second direction.

Regarding each of the first pressure chamber group 20A and the second pressure chamber group 20B, the second return portion 42 is located below the supply channel 30A, 30B (or located to one side of the supply channel in the third direction opposite to the pressure chambers) as illustrated in FIG. 3. In the third direction, the first supply portion 31 and the second supply portion 32, and the second return portion 42 define a damper chamber 50 therebetween.

The damper chamber 50 has a cross section orthogonal to the third direction, and the first supply portion 31 and the second supply portion 32 have a cross section orthogonal to the third direction. The cross section of the damper chamber 50 is greater than the cross section of the first supply portion 31 and the second supply portion 32. The cross section of the damper chamber 50 overlaps and includes the cross section of the first supply portion 31 and the second supply portion 32. Specifically, in the second direction, each damper chamber 50 is greater than the supply channel 30A, 30B, and protrudes toward an exterior of the channel substrate 11 relative to the supply channel 30A, 30B (by about 100 μm, for example).

In the third direction, the damper chamber 50 overlaps the first supply portion 31, the second supply portion 32, the supply communicating portions 24 and the narrowed portions 23, but does not overlap any of the pressure chambers 20.

The damper chamber 50 has through holes 59 at its both ends in the first direction as illustrated in FIG. 2, communicating with air. The damper chamber 50 thus receives pressure equal to atmospheric pressure.

The damper chamber 50 is defined by a supply damper film 51 and a return damper film 52. The supply damper film 51 defines the first supply portion 31 and the second supply portion 32. The return damper film 52 defines the second return portion 42.

The channel substrate 11 is made of 10 plates 11*a*-11*j* stacked in the third direction.

Of the plates 11*a*-11*j*, a plate 11*g* defining upper surfaces of the second return portions 42 has an upper surface with recesses, which may be formed by half-etching. The recesses define respective damper chambers 50. The recesses have bottom or most recessed portions overlapping the respective second return portions 42 in the third direction. The overlapping portions function as return damper films 52.

Of the plates 11*a*-11*j*, a plate 11*f* defining lower surfaces of the first supply portions 31 and the second supply portions 32 is bonded to the upper surface of the plate 11*g* to cover the recesses thereof. The plate 11*f* has portions covering the recesses and overlapping the first supply portions 31 and the second supply portions 32 in the third direction. The portions function as supply damper films 51.

As illustrated in FIG. 3, each supply damper film 51 has a dimension L1, which is smaller in the second direction than a dimension L2 of a corresponding return damper film 52. The supply damper film 51 has a lower Young's modulus than the return damper film 52. The plate 11*f* may be made of resin (e.g., polyimide), and the plate 11*g* may be made of metal (e.g., stainless steel, SUS).

An upper surface of each return damper film 52 (defining a damper chamber 50) has protrusions 53 in an area overlapping the first supply portion 31 in the third direction. The protrusions 53 are made of resin (e.g., polyimide) applied to the upper surface of each return damper film 52, and are thus flexible.

In this embodiment, the protrusions 53 are provided only in an area overlapping the first supply portion 31 in the third direction, but not provided in an area overlapping the second supply portion 32 in the third direction.

Of the plates 11*a*-11*j*, a plate 11*e* defining side surfaces of the second supply portions 32 overlaps, in the third direction, a plate 11*h* defining side surfaces of the second return portions 42. The plate 11*e* has walls 11*ew* each defining an end of a second supply portion 32 in the second direction (toward the pressure chamber 20 or opposite to the first supply portion 31 in the second direction). The plate 11*h* has walls 11*hw* each defining an end of a second return portion 42 in the second direction (toward the pressure chamber 20 or opposite to the first return portion 41 in the second direction). The walls 11*ew* and the walls 11*hw* are located at the same positions in the second direction. The plate 11*e* is an example of a first member and the plate 11*h* is an example of a second member.

The pressure chambers 20 and the narrowed portions 23 are defined by through holes in a plate 11*c*. The nozzles 21 are defined by through holes in a plate 11*j*.

In addition to the through holes defining the pressure chambers 20 and the narrowed portions 23, the plate 11*c* has through holes defining the first supply portions 31 of the supply channels 30A, 30B, and the first return portions 41 of the return channels 40A, 40B.

The actuator substrate 12 includes a vibrating plate 12*a*, a common electrode 12*b*, a plurality of piezoelectric members 12*c*, and a plurality of individual electrodes 12*d*, which are stacked one on another in this order from below.

The vibrating plate 12*a* is located on an upper surface of the plate 11*c* and the common electrode 12*b* is located on an upper surface of the vibrating plate 12*a*. The vibrating plate 12*a* and the common electrode 12*b* are located between through holes defining the first supply portions 31 of the supply channels 30A, 30B, and cover all the pressure chambers 20 and the narrowed portions 23 formed in the plate 11*c*. A piezoelectric member 12*c* and an individual electrode 12*d* are provided for each pressure chamber 20 and overlap each pressure chamber 20 in the third direction.

Figure 4:
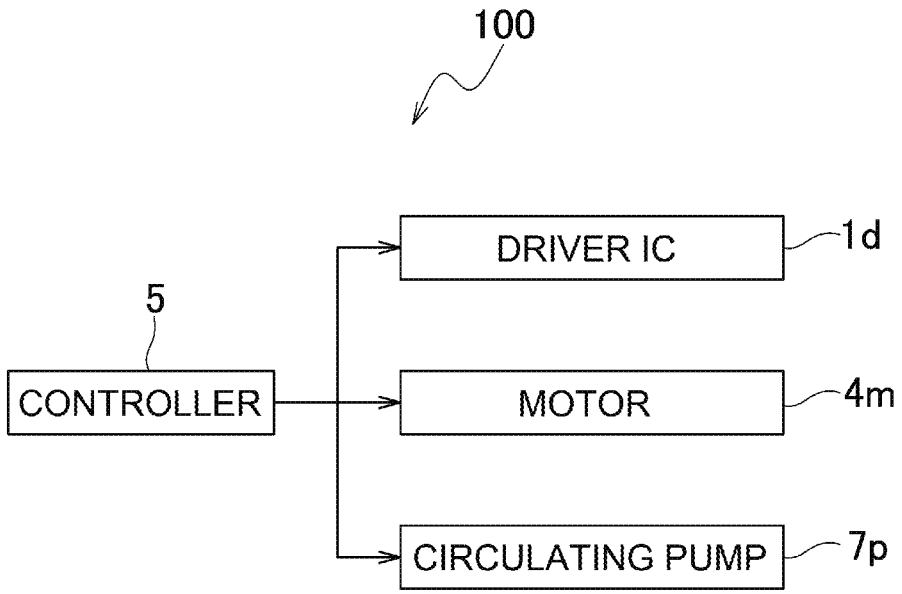
FIG. 4 is a block diagram illustrating an electrical system of the printer.

The common electrode 12*b* and the individual electrodes 12*d* are electrically connected to a driver IC 1*d* (FIG. 4). The driver IC 1*d* changes the potential of each of the individual electrodes 12*d*, while maintaining the common electrode 12*b* at the ground potential. Specifically, the driver IC 1*d* generates drive signals based on control signals from the controller 5 and transmits the drive signals to the individual electrodes 12*d*. The potential of each of the individual electrodes 12*d* is thus changed to between a specified drive potential and the ground potential. At this time, an individual electrode 12*d* whose potential is changed to a drive potential causes a corresponding piezoelectric member 12*c* to become deformed, and thus a portion of the actuator substrate 12 that is sandwiched between the individual electrode 12*d* and the vibrating plate 12*a* and that overlaps the deformed piezoelectric member 12*c* in the third direction (that is, an actuator 12*x*) protrudes toward a corresponding pressure chamber 20. The capacity of the pressure chamber 20 is thus changed and ink in the pressure chamber 20 is pressurized and ejected, in form of ink droplets, from the nozzle 21 communicating with the pressure chamber 20.

The protective substrate 13 is bonded to an upper surface of the vibrating plate 12*a*. Side surfaces of the protective substrate 13 define respective side surfaces of the first supply portions 31 of the supply channels 30A, 30B. An upper surface of the protective substrate 13 defines a lower surface of the merging channel 33.

A lower surface of the protective substrate 13 has two recesses 13*x*. The two recesses 13*x* extend in the first direction, one overlapping the pressure chambers 20 included in the first pressure chamber group 20A in the third direction, the other overlapping the pressure chambers 20 included in the second pressure chamber group 20B in the third direction. Each of the recesses 13*x* stores a plurality of actuators 12*x* for the pressure chambers 20 included in a corresponding one of the first and second pressure chamber groups 20A, 20B.

As described above, according to this embodiment, the first supply portion 31 and the first return portion 41 in each of the first pressure chamber group 20A and the second pressure chamber group 20B are located on one side (or the same side) of the pressure chambers 20 included in the pressure chamber group 20A, 20B in the second direction, and the first supply portion 31 is located between the first return portion 41 and each of the pressure chambers 20 in the second direction. Regarding each of the first pressure chamber group 20A and the second pressure chamber group 20B, the second return portion 42 is located below the supply channel 30A, 30B (or located to one side of the supply channel in the third direction opposite to the pressure chambers). The second supply portion 32 extends from the lower end portion of the first supply portion 31 (or an end portion of the first supply portion on one side in the third direction, opposite to the pressure chambers) toward the pressure chamber 20 (toward the other side in the second direction). The supply communicating portions 24 are located, not on a side of, but above the second supply portion 32 (or to the other side of the second supply portion in the third direction or adjacent to the second supply portion in the third direction). Even when the head 1 is reduced in size in the width direction of the supply channel 30A, 30B (that is, in the second direction), this structure enables maintaining of the width of the supply channel 30A, 30B largely, thus maintaining the size of the damper chamber 50 larger than that of the supply channel 30A, 30B. Specifically, the damper chamber 50 is located over, not only the first supply portion 31, but also both of the first supply portion 31 and the second supply portion 32, so that the size of the damper chamber 50 is larger than that of the supply channel 30A, 30B.

The compliance of a common channel including the supply channel 30A, 30B and the return channel 40A, 40B is about 20 times larger than that of each actuator 12*x* in general.

In the third direction, the first supply portion 31 and the second supply portion 32, and the second return portion 42 define a damper chamber 50 therebetween (FIG. 3). In this case, the damper films 51, 52 that define the damper chamber 50 are not exposed. If exposed, the damper films 51, 52 may become prone to breakage by contact with a sheet 9. This embodiment, however, may prevent breakage of the damper films 51, 52, as the damper films 51, 52 are not exposed. This structure allows a single damper chamber 50 to achieve a damping effect on both the supply channel 30A, 30B and the return channel 40A, 40B and is simpler than a structure where damper chambers are provided for individual channels in a one-to-one relationship.

The cross section, orthogonal to the third direction, of the damper chamber 50 is greater than the cross section, orthogonal to the third direction, of the first supply portion 31 and the second supply portion 32. The cross section of the damper chamber 50 overlaps and includes the cross section of the first supply portion 31 and the second supply portion 32 (FIG. 3). According to this embodiment, the damper chamber 50 which is larger in size than the supply channel enhances a damping effect. Even when there is a misalignment between the bonded plates 11*a*-11*j* in the third direction, the damper chamber 50 reliably overlaps both of the first supply portion 31 and the second supply portion 32 in the third direction, thus ensuring a damping effect.

The damper chamber 50 overlaps none of the pressure chambers 20 in the third direction (FIG. 3). If the damper chamber 50 is designed to overlap the pressure chambers 20 in the third direction, some of the plates 11*a*-11*j* should be bonded at positions overlapping large spaces for the damper chamber 50 and the pressure chambers 20 in the third direction. This may limit a pressing force with which the plates 11*a*-11*j* are bonded, and thus lead to insufficient bonding. This embodiment, however, may prevent such insufficient bonding as large spaces for the damper chamber 50 and its associated pressure chambers 20 do not overlap in the third direction.

Each supply damper film 51 has a dimension L1, which is smaller in the second direction than a dimension L2 of each return damper film 52 (FIG. 3). The Young's modulus of the supply damper film 51 is lower than that of the return damper film 52. If the supply damper film 51 and the return damper film 52 are designed to have the same low Young's modulus, the return damper film 52, which is greater in the second direction, may excessively bend and stick to the supply damper film 51, and thus no space for the damper chamber 50 may be left. According to this embodiment, however, the Young's modulus of the supply damper film 51, which is smaller in the second direction, is lower than that of the return damper film 52, thereby facilitating bending of the supply damper film 51 and impeding bending of the return damper film 52. Thus, the damper films 51, 52 are prevented from sticking to each other and a space for the damper chamber 50 is left.

Each return damper film 52 includes the protrusions 53 on its upper surface defining the damper chamber 50. According to this embodiment, when bending, the damper film 51 may first contact the tip of a protrusion 53 and then contact the damper film 52, thereby preventing the damper film 51 from sticking to the damper film 52.

The protrusions 53 are flexible. According to this embodiment, not only the damper films 51, 52 but also the protrusions 53 may bend, thereby enhancing a damping effect.

The protrusions 53 overlap each first supply portion 31 in the third direction (FIG. 3). The supply opening 30*x* is provided at the upper end of each first supply portion 31. As ink flows vigorously below the supply opening 30*x*, the damper films 51, 52 are likely to bend greatly and thus stick to each other. In this regard, according to this embodiment, the protrusions 53 are provided below the supply opening 30*x*, thereby preventing the damper films 51, 52 from sticking to each other. The protrusions 53 also produce a damping effect on ink flowing vigorously below the supply opening 30*x*.

The damper chamber 50 communicates with air via the through holes 59 (FIG. 2). According to this embodiment, as the damper chamber 50 is not an enclosed space, the damper films 51, 52 are likely to bend, thereby enhancing a damping effect.

The narrowed portions 23 and the pressure chambers 20 are located above the supply communicating portions 24 (or located to the other side in the third direction relative to the supply communicating portions) (FIG. 3). If the narrowed portions 23 and the pressure chambers 20 are designed to be level with the supply communicating portions 24, an area including the narrowed portions 23, the pressure chambers 20, and the supply communicating portions 24 may increase in the second direction. In this embodiment, however, the narrowed portions 23 and the pressure chambers 20 are located at a level different from that of the supply communicating portions 24, thus obviating the need to increase, in the second direction, the size of portions including the supply communicating portions 24, the narrowed portions 23, and the pressure chambers 20.

The first end 23*a* of each narrowed portion 23 in the second direction overlaps a corresponding supply communicating portion 24 in the third direction (FIG. 2). If the first end 23*a* is located at such a position that it does not overlap a corresponding supply communicating portion 24 in the third direction and is closer to an exterior of the channel substrate 11 than the supply communicating portion 24 in the second direction (or is opposite to a corresponding pressure chamber 20 relative to the supply communicating portion 24 in the second direction), air bubbles may be likely to collect at the first end 23*a*. This embodiment, however, may prevent air bubbles from collecting at the first end 23*a*, as the first end 23*a* is not located at such a position.

The walls 11*ew* of the plate 11*e* each defining an end of each second supply portion 32 in the second direction (toward the pressure chamber 20 or opposite to the first supply portion 31 in the second direction) are located at the same positions in the second direction as the walls 11*hw* of the plate 11*h* each defining an end of each second return portion 42 in the second direction (toward the pressure chamber 20 or opposite to the first return portion 41 in the second direction) (FIG. 3). According to this embodiment, the walls 11*ew*, 11*hw* are located at the same positions in the second direction. During manufacture of the channel substrate 11, the plates 11*a*-11*j* are bonded to one another with sufficient pressing force, thus preventing insufficient bonding.

Second Embodiment

Figure 5:
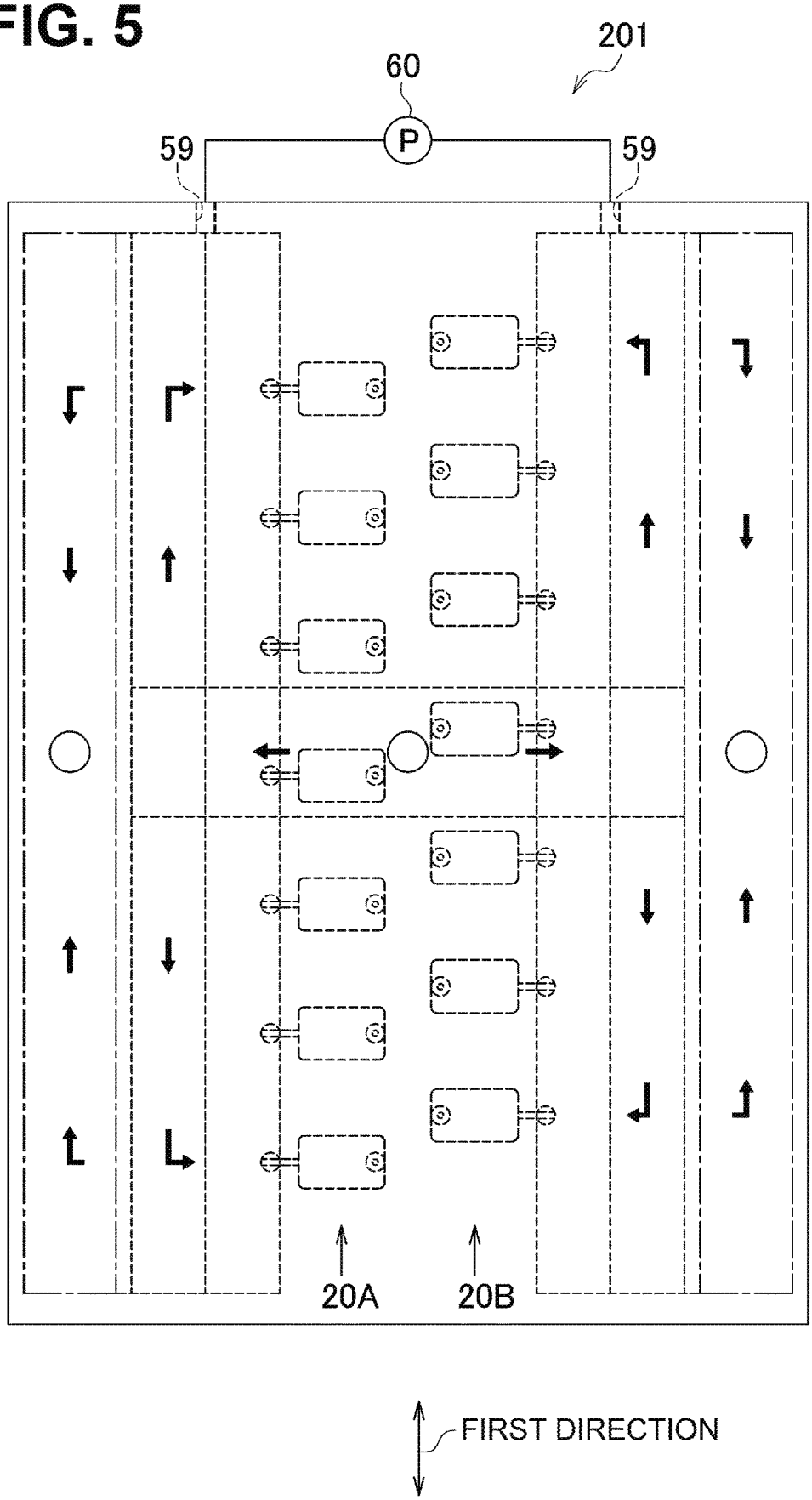
FIG. 5 is a plan view of a head according to a second embodiment of the disclosure.

Referring to FIG. 5, heads 201 according to a second embodiment of the disclosure will be described. In the second embodiment, elements illustrated and described in the first embodiment are designated by the same reference numerals, and thus the description thereof will be omitted.

In the second embodiment, the damper chamber 50 (FIG. 3) does not communicate with air and thus is at a reduced pressure, although the first embodiment illustrates that the damper chamber 50 (FIG. 3) communicates with air via the through holes 59 (FIG. 2) and is at the same pressure as atmospheric pressure.

Specifically, in the second embodiment, each damper chamber 50 (FIG. 3), which is provided for a corresponding one of the first pressure chamber group 20A and the second pressure chamber group 20B, has a through hole 59 only at one end in the first direction. The damper chamber 50 is connected through the through hole 59 to a pressure reducing pump 60. The pressure reducing pump 60 is controlled by the controller 5 to reduce a pressure in the damper chamber 50 to below a pressure in any of the first supply portion 31, the second supply portion 32, and the second return portion 42.

As described above, the second embodiment may have the following effects in addition to the effects obtained from the similar structure to that described in the first embodiment.

According to Le Chatelier's principle, when the pressure is increased, the position of equilibrium will move in such a direction as to reduce the pressure by reducing the number of molecules. Thus, when the pressure in the damper chamber 50 is increased, foreign matter (e.g., air bubbles) in the damper chamber 50 may pass through the damper films 51, 52 and enter the first supply portion 31, the second supply portion 32, or the second return portion 42. In this regard, this embodiment obviates the need to raise such a problem, as the pressure in the damper chamber 50 is lower than the pressure in any of the first supply portion 31, the second supply portion 32, and the second return portion 42.

Alternative Embodiments

The above embodiments are merely examples. Various changes, arrangements and modifications may be applied therein without departing from the spirit and scope of the disclosure.

The second direction is not limited to being orthogonal to the first direction, but may cross the first direction.

The merging channel 33 may be omitted. Alternatively, in the above embodiments, a tube connected to a sub tank may be attached to the supply opening 30*x* of each supply channel 30A, 30B. In this case, a sub tank may be provided for each pressure chamber group 20A, 20B. A sub tank connected to a tube in the supply opening 30*x* of the supply channel 30A and a sub tank connected to a tube in the supply opening 30*x* of the supply channel 30B may each store a different type (e.g., color) of liquid.

The protective substrate 13 may be omitted. In this case, the merging channel 33 may be defined by a member different from the protective substrate 13. Alternatively, the merging channel 33 and the protective substrate 13 may be omitted. In this case, the upper surfaces of the supply channels 30A, 30B may be level with the upper surfaces of the pressure chambers 20.

The first return portion 41 may have a width equal to or smaller than that of the first supply portion 31.

The supply openings 30*x* and the return openings 40*x* are provided at the upper surfaces of the supply channels 30A, 30B and the return channels 40A, 40B, but are not limited to this structure. The supply openings 30*x* and the return openings 40*x* may be provided at lower surfaces or side surfaces of the supply channels 30A, 30B and the return channels 40A, 40B.

The above embodiments show, but not limited to, each pressure chamber group 20A, 20B including a single row of pressure chambers 20. Each pressure chamber group 20A, 20B may include a plurality of rows of pressure chambers 20. In this case, a supply channel 30A, 30B and a return channel 40*a*, 40B may be provided for each row of the pressure chambers 20.

The above embodiments show but not limited to that the supply channel 30A, the return channel 40A, the narrowed portions 23, the supply communicating portions 24, and the return communicating portions 25, which are provided for the first pressure chamber group 20A, are located opposite to the second pressure chamber group 20B relative to the first pressure chamber group 20A in the second direction, and the supply channel 30B, the return channel 40B, the narrowed portions 23, the supply communicating portions 24, and the return communicating portions 25, which are provided for the second pressure chamber group 20B, are located opposite to the first pressure chamber group 20A relative to the second pressure chamber group 20B in the second direction. For example, the supply channel 30A, the return channel 40A, the narrowed portions 23, the supply communicating portions 24, and the return communicating portions 25, which are provided for the first pressure chamber group 20A, and those which provided for the second pressure chamber group 20B may be located on the same side of each of the first pressure chamber group 20A and the second pressure chamber group 20B in the second direction, such that the first pressure chamber group 20A and the second pressure chamber group 20B sandwich therebetween those which provided for the first pressure chamber group 20A or the second pressure chamber group 20B.

Each head 1, 201 may include a single pressure chamber group and a supply channel and a return channel which each communicate with the single pressure chamber group.

The narrowed portions 23 and the pressure chambers 20 may be level with the supply communicating portions 24. Alternatively, the supply communicating portions 24, the narrowed portions 23, and the pressure chambers 20 may be located at different levels. However, as described in the above embodiment, the narrowed portions 23 and the pressure chambers 20 are formed from a single member (the plate 11*c*). This eliminates the need to perform an etching process for forming narrowed portions 23 and an etching process for forming pressure chambers 20 individually. The narrowed portions 23 and the pressure chambers 20 are formed in a one-time etching process, thereby facilitating manufacturing of heads 1, 201.

The narrowed portions 23 may be omitted by narrowing the widths of the supply communicating portions 24.

Each damper chamber 50 may be designed to communicate with air at only one location (e.g., at only one end in the first direction). However, as in the first embodiment, each damper chamber 50 communicates with air via the through holes 59, thereby effectively releasing adhesive residues from the bonded plates of the channel substrate 11.

Each damper chamber 50 may overlap the pressure chambers 20 in the third direction. The cross section, orthogonal to the third direction, of the damper chamber 50 may coincide with the cross section, orthogonal to the third direction, of the first supply portion 31 and the second supply portion 32. Alternatively, the cross section of the damper chamber 50 may be smaller than the cross section of the first supply portion 31 and the second supply portion 32.

To lower the Young's modulus of the supply damper film 51 than that of the return damper film 52, the supply damper film 51 and the return damper film 52 may be made of different materials or of different thickness. For example, the supply damper film 51 may be thinner than the return damper film 52.

The supply damper film 51 and the return damper film 52 may be made of the same material. For example, the supply damper film 51 and the return damper film 52 may be made of resin (e.g., polyimide), and sandwich therebetween a plate made of metal (e.g., stainless steel, SUS).

The dimension in the second direction of the supply damper film 51 may be equal to or greater than that of the return damper film 52. When the dimension in the second direction of the supply damper film 51 is equal to that of the return damper film 52, the Young's modulus of the supply damper film 51 may be equal to that of the return damper film 52. When the dimension in the second direction of the supply damper film 51 is greater than that of the return damper film 52, the Young's modulus of the supply damper film 51 may be higher than that of the return damper film 52.

In the above embodiments, the protrusions 53 are provided at the return damper film 52, but may be provided at the supply damper film 51 or both of the supply damper film 51 and the return damper film 52.

The protrusions 53 may not be flexible.

The protrusions 53 may be provided in an area overlapping the second supply portion 32 in the third direction. In this case, a density of protrusions 53 provided in an area overlapping the first supply portion 31 in the third direction is greater than a density of protrusions 53 provided in an area overlapping the second supply portion 32 in the third direction. Adjusting the density of protrusions 53 obviates the need to increase the number of protrusions 53 excessively, and also produces a damping effect on ink flowing vigorously below the supply opening 30*x*.

The protrusions 53 may be provided at a uniform density.

The damper chamber 50 may not be provided between the first supply portion 31 and the second supply portion 32, and the second return portion 42 in the third direction. Instead, a damper film may be provided therebetween. In this case, one surface of the damper film may define the first supply portion 31 and the second supply portion 32 and the other surface thereof may define the second return portion 42.

In the above embodiments, a single nozzle 21 communicates with a single pressure chamber 20. However, two or more nozzles 21 may communicate with a single pressure chamber 20. Alternatively, a single nozzle 21 may be provided for two or more pressure chambers 20.

The heads 1, 201 are not limited to line heads. The heads may be serial heads (which eject liquid droplets to a target object from nozzles while moving in a scanning direction parallel to the sheet width direction).

The target object is not limited to a sheet of paper, but may be, for example, a cloth, a substrate, and other materials.

A liquid to be ejected from nozzles in form of droplets is not limited to ink, but may be any liquids, for example, a process liquid for condensation or precipitation of an ink component.

The disclosure may be applied to not only printers but also other apparatus such as a facsimile, a copier, and a multifunction apparatus. The disclosure may be applied to various liquid ejection devices intended for, not only image recording on sheets, but also conductive pattern forming to form conductive patterns on substrates by ejecting a conductive liquid thereon.

What is claimed is:

1. A liquid ejection head comprises:

a plurality of pressure chambers arranged in a first direction;

a plurality of supply communicating portions each communicating with a corresponding one of the pressure chambers;

a supply channel extending in the first direction and communicating with each of the supply communicating portions;

a plurality of return communicating portions each communicating with a corresponding one of the pressure chambers; and a return channel extending in the first direction and communicating with each of the return communicating portions, wherein the supply channel includes:

a first supply portion located to one side of each of the pressure chambers in a second direction orthogonal to the first direction; and a second supply portion connecting the first supply portion and the supply communicating portions, wherein the return channel includes:

a first return portion located to the one side of each of the pressure chambers in the second direction, the first return portion and each of the pressure chambers sandwiching the first supply portion of the supply channel therebetween in the second direction; and a second return portion connecting the first return portion and the return communicating portions, wherein the second return portion of the return channel extends from the first return portion toward the pressure chambers in the second direction and is located to a side of the supply channel opposite in a third direction to the pressure chambers, the third direction being orthogonal to both the first direction and the second direction, wherein the second supply portion of the supply channel extends from an end portion of the first supply portion in the third direction toward the pressure chambers in the second direction, and wherein the supply communicating portions are located adjacent to the second supply portion in the third direction.

2. The liquid ejection head according to claim 1, wherein the first supply portion and the second supply portion of the supply channel and the second return portion of the return channel define a damper chamber therebetween in the third direction.

3. The liquid ejection head according to claim 2, wherein the damper chamber has a cross section orthogonal to the third direction, the supply channel has a cross section orthogonal to the third direction, the cross section of the damper chamber is greater than the cross section of the supply channel, and the cross section of the damper chamber overlaps and includes the cross section of the supply channel.

4. The liquid ejection head according to claim 2, wherein the damper chamber overlaps none of the pressure chambers in the third direction.

5. The liquid ejection head according to claim 2, further comprising:

a supply damper film defining the first supply portion and the second supply portion of the supply channel; and a return damper film defining the second return portion of the return channel, wherein the damper chamber is defined by the supply damper film and the return damper film, wherein the supply damper film is smaller than the return damper film in the second direction, and wherein the supply damper film has a lower Young's modulus than the return damper film.

6. The liquid ejection head according to claim 5, wherein at least one of the supply damper film and the return damper film has a surface defining the damper chamber and includes a plurality of protrusions on the surface.

7. The liquid ejection head according to claim 6, wherein the protrusions are flexible.

8. The liquid ejection head according to claim 6, wherein the first supply portion of the supply channel has a supply opening at an end of the first supply portion opposite in the third direction to the damper chamber, and wherein the protrusions overlap the first supply portion of the supply channel in the third direction.

9. The liquid ejection head according to claim 8, wherein the protrusions overlap the second supply portion of the supply channel in the third direction, and wherein a density of the protrusions provided in an area overlapping the first supply portion in the third direction is greater than a density of the protrusions provided in an area overlapping the second supply portion in the third direction.

10. The liquid ejection head according to claim 2, wherein the damper chamber communicates with the air.

11. The liquid ejection head according to claim 2, wherein a pressure in the damper chamber is lower than a pressure in any of the first supply portion, the second supply portion, and the second return portion.

12. The liquid ejection head according to claim 1, further comprising:

a plurality of narrowed portions each communicating with a corresponding one of the pressure chambers and a corresponding one of the supply communicating portions, each of the narrowed portions being smaller in width than the corresponding one of the supply communicating portions, wherein the narrowed portions and the pressure chambers are located to a side of each of the supply communicating portions opposite in the third direction to the second supply portion.

13. The liquid ejection head according to claim 12, wherein each of the narrowed portions has a first end and a second end in the second direction, and communicates with a corresponding one of the supply communicating portions at the first end and a corresponding one of the pressure chambers at the second end.

14. The liquid ejection head according to claim 1, further comprising:

a first member defining the second supply portion of the supply channel, wherein the first member has a wall defining an end of the second supply portion opposite in the second direction to the first supply portion; and a second member defining the second return portion of the return channel and overlapping the first member in the third direction, wherein the second member has a wall defining an end of the second return portion opposite in the second direction opposite to the first return portion, wherein the wall of the first member and the wall of the second member are located at the same position in the second direction.

15. A liquid ejection head comprises:

a plurality of pressure chambers arranged in a first direction;

a plurality of supply communicating portions each communicating with a corresponding one of the pressure chambers;

a supply channel extending in the first direction and communicating with each of the supply communicating portions;

a plurality of return communicating portions each communicating with a corresponding one of the pressure chambers; and a return channel extending in the first direction and communicating with each of the return communicating portions, wherein the supply channel includes:

a first supply portion located to one side of each of the pressure chambers in a second direction orthogonal to the first direction; and a second supply portion connecting the first supply portion and the supply communicating portions, wherein the return channel includes:

a first return portion located to the one side of each of the pressure chambers in the second direction, the first return portion and each of the pressure chambers sandwiching the first supply portion of the supply channel therebetween in the second direction; and a second return portion connecting the first return portion and the return communicating portions, wherein the second return portion of the return channel extends from the first return portion toward the pressure chambers in the second direction and is located below the supply channel, wherein the second supply portion of the supply channel extends from the first supply portion toward the pressure chambers in the second direction and is located below the pressure chambers, and wherein the supply communicating portions are located above the second supply portion.

* * * * *